US009022359B2

(12) United States Patent
McAlmond

(10) Patent No.: US 9,022,359 B2
(45) Date of Patent: May 5, 2015

(54) GATE STOP

(71) Applicant: WRF Enterprises, LLC, Paris, KY (US)

(72) Inventor: Jeffrey K. McAlmond, Paris, KY (US)

(73) Assignee: WRF Enterprises, LLC, Paris, KY (US)

( * ) Notice: Subject to any disclaimer, the term of this patent is extended or adjusted under 35 U.S.C. 154(b) by 0 days.

(21) Appl. No.: 13/973,461

(22) Filed: Aug. 22, 2013

(65) Prior Publication Data

US 2014/0110655 A1 Apr. 24, 2014

Related U.S. Application Data

(60) Provisional application No. 61/717,394, filed on Oct. 23, 2012.

(51) Int. Cl.

| | |
|---|---|
| ***E06B 11/02*** | (2006.01) |
| ***E05F 5/06*** | (2006.01) |
| ***E05B 65/00*** | (2006.01) |
| ***E05B 67/38*** | (2006.01) |
| ***E05C 1/04*** | (2006.01) |
| *E05B 15/02* | (2006.01) |

(52) U.S. Cl.

CPC . *E06B 11/02* (2013.01); *E05F 5/06* (2013.01); *E05Y 2201/218* (2013.01); *E05Y 2900/40* (2013.01); *E05B 65/0007* (2013.01); *E05B 67/383* (2013.01); *E05C 1/04* (2013.01); *E05B 15/0205* (2013.01)

(58) Field of Classification Search

CPC .... E06B 11/02; E05B 65/0007; A01K 1/0017

USPC ..... 256/73; 292/137, 157, 183, 189, 262, 292/DIG. 15, DIG. 29; 49/394

See application file for complete search history.

(56) References Cited

U.S. PATENT DOCUMENTS

| | | | | | |
|---|---|---|---|---|---|
| 1,086,749 | A | * | 2/1914 | Brenneman | 292/175 |
| 1,355,371 | A | * | 10/1920 | Welsh | 292/57 |
| 1,723,007 | A | * | 8/1929 | Bittorf | 292/57 |
| 2,793,897 | A | * | 5/1957 | Hendrickson | 292/210 |
| 3,174,314 | A | * | 3/1965 | Johnson | 70/77 |
| 4,263,749 | A | * | 4/1981 | McDougle | 49/394 |
| 4,790,578 | A | * | 12/1988 | Barrera | 292/148 |
| D396,795 | S | * | 8/1998 | Francom | D8/339 |
| 6,039,308 | A | * | 3/2000 | Venegas, Jr. | 256/73 |
| 6,739,093 | B1 | * | 5/2004 | Holbert | 49/394 |
| 7,350,835 | B1 | * | 4/2008 | Smith | 292/148 |
| 7,950,702 | B1 | * | 5/2011 | Adams | 292/1 |
| 8,794,681 | B2 | * | 8/2014 | Crosse | 292/189 |

* cited by examiner

*Primary Examiner* — Joshua Kennedy
(74) *Attorney, Agent, or Firm* — Dinsmore & Shohl LLP

(57) ABSTRACT

A gate assembly may include a gate with a first rail and a second rail. A first guide assembly may include a first mounting piece and a first securing piece. The first mounting piece may include a first ring portion and a first rail securing portion. The first ring portion may define a first rod aperture and may be coupled to the first rail securing portion. The first securing piece may be used to secure the first guide assembly to the first rail of the gate. The gate assembly may also include a drop rod that may be inserted into the rod aperture to sideably couple the drop rod with the first guide assembly thereby substantially aligning the drop rod vertically, relative to ground. When the drop rod is put in a disengaged position, the drop rod removably couples to the second rail to allow motion of the gate.

10 Claims, 7 Drawing Sheets

GATE STOP

CROSS REFERENCE TO RELATED APPLICATIONS

The present application hereby claims priority under 35 U.S.C. §119(e) to Provisional U.S. Application No. 61/717,394 filed Oct. 23, 2012 entitled "Gate Stop," which is herein incorporated by reference in its entirety.

TECHNICAL FIELD

The present specification generally relates to an apparatus for keeping a gate from opening or closing and, more specifically, to a gate stop.

BACKGROUND

In many agricultural and domestic environments, land owners, land managers, farmers, and/or others may have an area of land they manage. The area of land may have crops, livestock, residential property, and/or other resources. Accordingly, the land owner may erect an enclosing fence around the boundary of the area of land to keep livestock from escaping, predators from entering, to restrict trespassing, and/or for other reasons. The enclosing fence may define an opening to provide access to the area of land. The opening may be large enough for a person, vehicle, livestock, and/or other entity to enter and exit the area of land. The fencing may be coupled to a hinged gate at the opening that may be opened and closed to provide access to the area of land, while keeping the area of land enclosed. The hinged gate may be constructed of metal, wood, plastic, or similar material. While the hinged gate may provide restricted access to the area of land, oftentimes, keeping the hinged gate in place, either when open or closed, may become an issue.

SUMMARY

In one embodiment, a gate stop for securing a gate with a first rail and a second rail may include a first guide assembly that includes a first mounting piece and a first securing piece. The first mounting piece may include a first ring portion and a first rail securing portion. The first ring portion may define a first rod aperture and may be coupled to the first rail securing portion. The first securing piece may define a first mount aperture and the first mount aperture may receive the first rail securing portion of the first mounting piece to secure the first guide assembly to the first rail of the gate. The gate stop may also include a drop rod with a handle portion, a curved neck portion, and a rod securing portion. The handle portion may be coupled to the curved neck portion. The curved neck portion may be coupled to the rod securing portion. The rod securing portion may be inserted into the first rod aperture to sideably couple the drop rod with the first guide assembly thereby substantially aligning the drop rod vertically, relative to ground. When the gate stop is put in a disengaged position, the curved neck portion removably couples to the second rail to allow motion of the gate.

In another embodiment, an apparatus for a gate assembly may include a gate with a first rail and a second rail where the gate is coupled to an upright post. A first guide assembly may include a first mounting piece and a first securing piece. The first mounting piece may include a first ring portion and a first rail securing portion. The first ring portion may define a first rod aperture and may be coupled to the first rail securing portion. The first securing piece may define a first mount aperture that receives the first rail securing portion of the first mounting piece to secure the first guide assembly to the first rail of the gate. The gate assembly may also include a drop rod with a handle portion, a curved neck portion, and a rod securing portion. The handle portion may be coupled to the curved neck portion, which is coupled to the rod securing portion and may be inserted into the rod aperture to sideably couple the drop rod with the first guide assembly thereby substantially aligning the drop rod vertically, relative to ground. When the drop rod is positioned in a disengaged position, the curved neck portion removably couples to the second rail to allow motion of the gate. The gate assembly may also include a disengagement securing piece that may be coupled to the gate and removably secures the drop rod in the disengaged position.

In yet another embodiment, an apparatus for a gate assembly may include a gate with a first rail, a second rail and a third rail. The gate may be coupled to an upright post and the second rail may be vertically elevated above both the first rail and the third rail. A first guide assembly may include a first mounting piece and a first securing piece. The first mounting piece may include a first ring portion and a first rail securing portion. The first ring portion may define a first rod aperture and may be coupled to the first rail securing portion. The first securing piece may define a first mount aperture and the first mount aperture may receive the first rail securing portion of the first mounting piece to secure the first guide assembly to the first rail of the gate. A second guide assembly may include a second mounting piece and a second securing piece. The second mounting piece may include a second ring portion and a second threaded u-shaped portion and may define a second rod aperture and a third plane and may be coupled to the second threaded u-shaped portion. The second securing piece may define a second mount aperture and a fourth plane. The fourth plane may be substantially orthogonal to the third plane. The second mount aperture may receive the second threaded u-shaped portion of the second mounting piece and may receive fastening devices that couple with the threads of the second threaded u-shaped portion to secure the second guide assembly to the third rail of the gate. A drop rod may also be included with a handle portion, a curved neck portion, and a rod securing portion. The handle portion may be coupled to the curved neck portion. The curved neck portion may be coupled to the rod securing portion and may be inserted into the rod aperture to sideably couple the drop rod with the first guide assembly thereby substantially aligning the drop rod vertically, relative to ground. When the drop rod is put in a disengaged position, the curved neck portion removably couples to the second rail to allow motion of the gate. A disengagement securing piece may be coupled to the gate and removably secures the drop rod in the disengaged position. The handle portion may define a handle aperture and the disengagement securing piece may define a disengaged aperture. When the drop rod is the disengaged position, the handle aperture and the disengaged aperture may align to allow a locking apparatus to secure the drop rod in the disengaged position.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments disclosed herein include a gate stop that may be utilized to keep a gate in a desired position. The gate may include a hinged end that couples to an enclosure fence and a swinging end that is opposite the hinged end. The gate stop may include a drop rod and one or more guide assemblies that are coupled to the gate and allow the drop rod to slide between a disengaged position and an engaged position. The handle portion of the drop rod is aligned in a first direction when the gate stop is put in the disengaged position to allow the curved neck portion to removably couple to the second rail and aligned in a second direction to allow the gate stop to be set in the engaged position. When the gate stop is put in the engaged position, the gate stop may contact the ground or a device coupled to ground, to prevent the gate from moving from its current position. While in some embodiments, the gate stop may be permanently assembled to the gate, in some embodiments, the gate stop may be a removable component. Various embodiments of the gate stop and the operation of the gate stop will be described in more detail herein.

Figure 1:
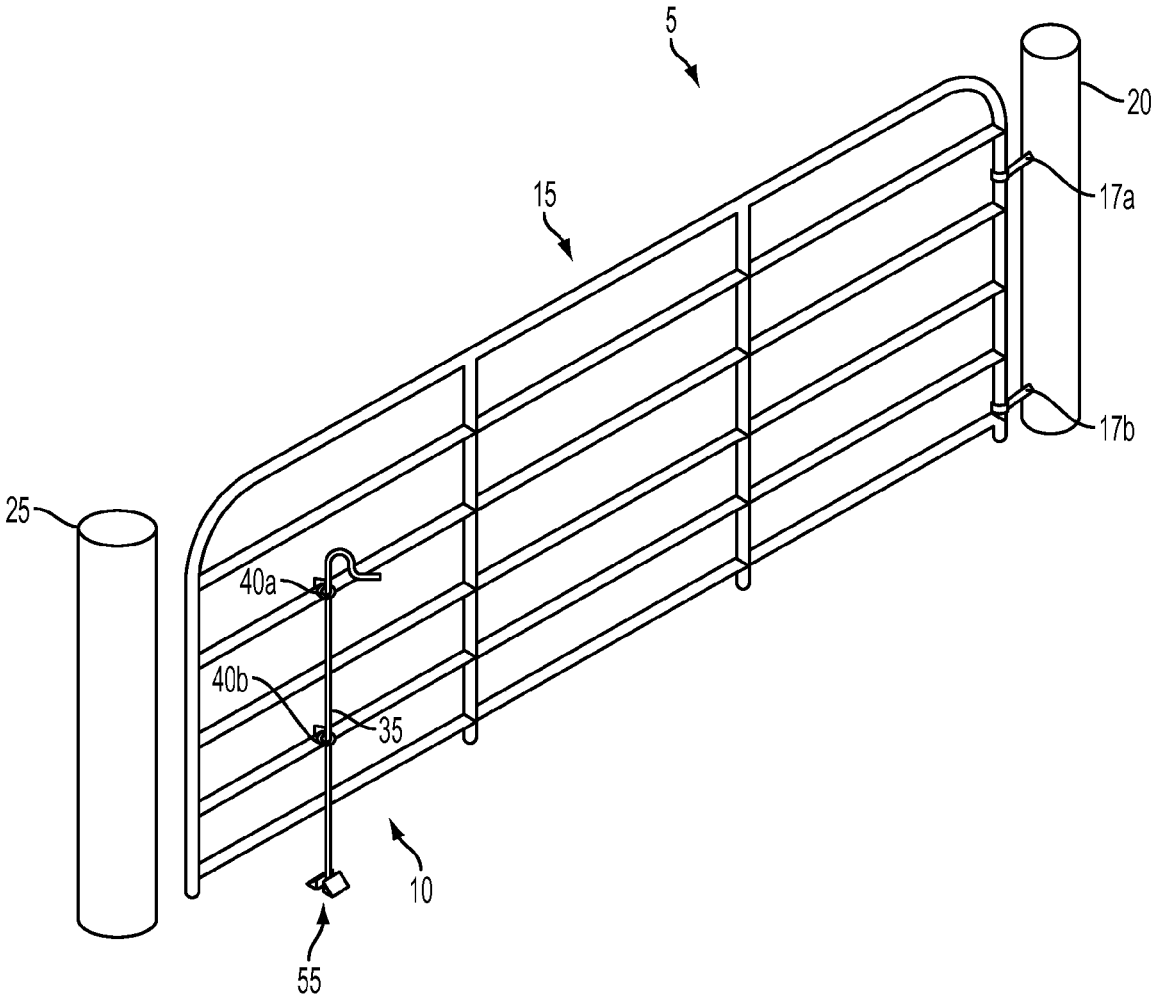
FIG. 1 depicts a gate with a gate stop positioned in an engaged position according to one or more embodiments shown and described herein.

Referring now to the drawings, FIG. 1 depicts a gate 5 with a gate stop 10 positioned in an engaged position according to one or more embodiments shown and described herein. The gate 5 may be defined by rails 15, which may be arranged in a manner such that when the gate is in use, at least a portion of the rails 15 are substantially parallel with the ground. The gate 5 may be coupled to an upright post 20 with one or more hinges 17*a*, 17*b*, which may be configured as barrel hinges, piano hinges, butterfly hinges, etc. The upright post 20 is coupled to an enclosing fence for enclosing an area of land or otherwise dividing two areas. Similarly, an end post 25 coupled to the opposite end of the gate 5. The area between the upright post 20 and the end post 25 defines a gate opening. The gate opening may be used to allow passage between an interior space of the enclosing fence and an exterior space of the enclosing fence.

It should be understood that while the gate 5 is coupled to an upright post 20 and an end post 25, this is merely an example. In some embodiments, at least one end of the gate 5 may be coupled to a house, barn, or other fixed structure. As an example, some embodiments may be configured with the gate 5 coupled to opposing interior surfaces of a doorway, to operate as a child gate, a pet gate, or the like.

It should also be understood that in some embodiments, the gate 5 may be configured to span the entirety of the gate opening. As an example, the gate 5 may be configured to engage with the end post 25, such that the gate 5 may only open in one direction. In some embodiments however, the gate 5 is configured to not engage with the end post 25, thereby allowing the gate 5 to open in either direction.

As also illustrated in FIG. 1, the gate stop 10 may be coupled to the gate 5 and may be used to restrict the movement of the gate 5 at a desired position. While the end post 25 may be utilized to prevent the gate 5 from opening in one direction, the end post 25 may only be used as a restriction of movement in one direction and at one specific point. The gate stop 10 however, may be utilized to removably secure the gate 5 in a predetermined position. The gate stop 10 may include a drop rod 35 and one or more guide assemblies 40*a*, 40*b* (generically and collectively referred to as guide assembly 40), as described in more detail below.

The gate stop 10 may be placed in the engaged position (as illustrated in FIG. 1) by removing the drop rod 35 from a first rail 15 (such as the top rail or the next rail in FIG. 1) and placing the drop rod 35 on a predetermined spot on the ground (either directly on the ground or coupling the drop rod 35 with an rod engagement piece 55). In some embodiments the rod engagement piece 55 is constructed of a pipe and may be vertically aligned (e.g., substantially perpendicular with the surface the ground) and buried in the ground to provide a fixed position for securing the gate 5. The rod engagement piece 55 may be constructed with an inner pipe diameter that is greater than a diameter of the drop rod 35 (an outer rod diameter), thereby allowing the drop rod 35 to slideably couple with the rod engagement piece 55. In some embodiments however, the rod engagement piece 55 may be configured as a curb (or plurality of curbs) that is placed on or secured to the ground. In such an embodiment, the rod engagement piece 55 may include a notch for receiving the drop rod 35. If the rod engagement piece 55 is configured as a plurality of curbs, the curbs may be spaced apart to accommodate the outer rod diameter of the drop rod 35. In still some embodiments, the rod engagement piece 55 may be configured as a pavement surface with a pavement aperture for receiving the drop rod 35.

It should be understood that while some embodiments of the rod engagement piece 55 are described above, these are merely examples. Other types of rod engagement pieces may be utilized for removably fixing the drop rod 35, thus securing the gate 5 in a desired position.

Figure 2:
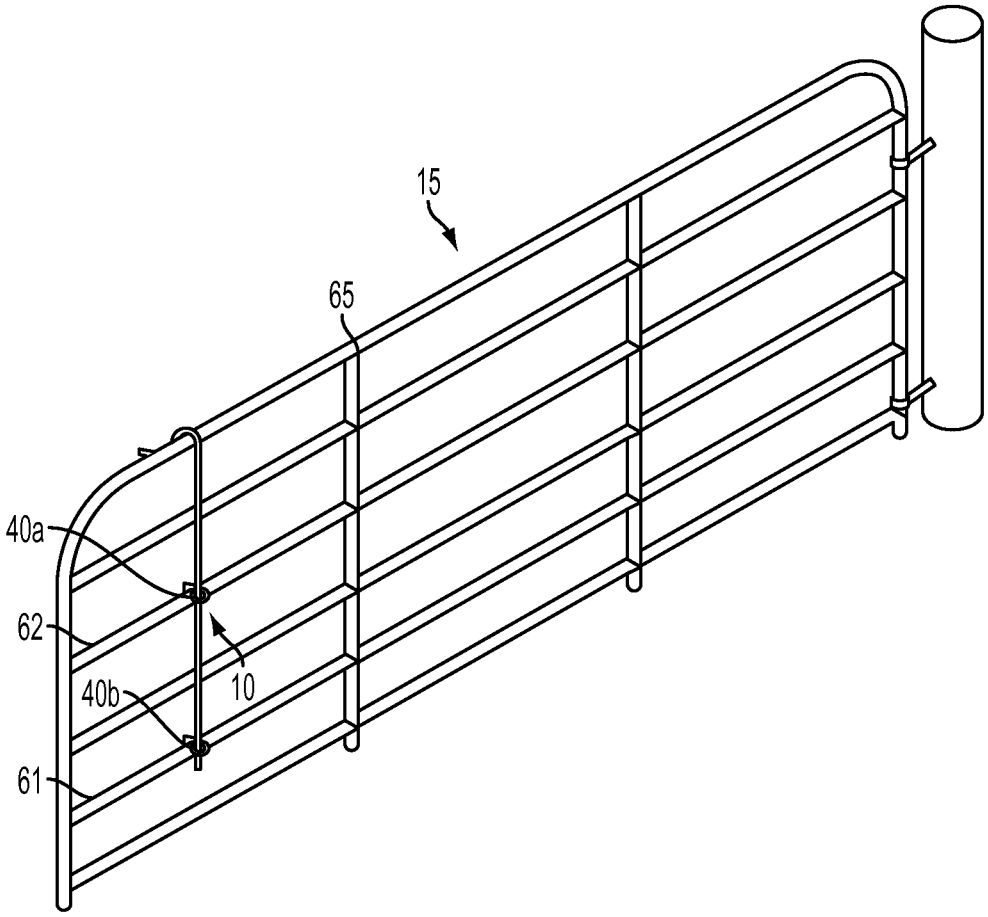
FIG. 2 depicts the gate stop in a disengaged position, according to one or more embodiments shown and described herein.

FIG. 2 depicts the gate stop 10 in a disengaged position, according to one or more embodiments shown and described herein. When placed in the disengaged position, the gate stop 10 removably couples with a second rail 65 of the gate 5, thereby allowing the gate 5 to open and close without encumbrance. As illustrated in FIGS. 1 and 2, to actuate the gate stop 10 from the engaged position to the disengaged position, the gate stop 10 may be lifted vertically in alignment with an aperture of at least one of the guide assemblies 40 until the handle portion 43 is above the second rail 65 of the gate 5. The gate stop 10 may then be rotated until the handle portion 43 is restricted from full downward motion by the second rail 65. The gate stop 10 may then be lowered until the curved neck portion 45 is removably coupled to the second rail 65 of the gate 5.

To actuate the gate stop 10 from the disengaged position to the engaged position, the gate stop 10 may be lifted vertically until the handle portion 43 is above the second rail 65 of the gate 5. The drop rod 35 may then be rotated until the handle portion 43 is not restricted by the gate 5 to allow the drop rod 35 to be lowed without interference with the gate 5. The drop rod 35 may then be lowered until the gate stop 10 engages the ground or the rod engagement piece 55. The gate stop 10 may also engage the ground instead of the rod engagement piece 55. This may be beneficial if the gate 5 is to remain in a relatively fixed position other than in a closed position.

Figure 3:
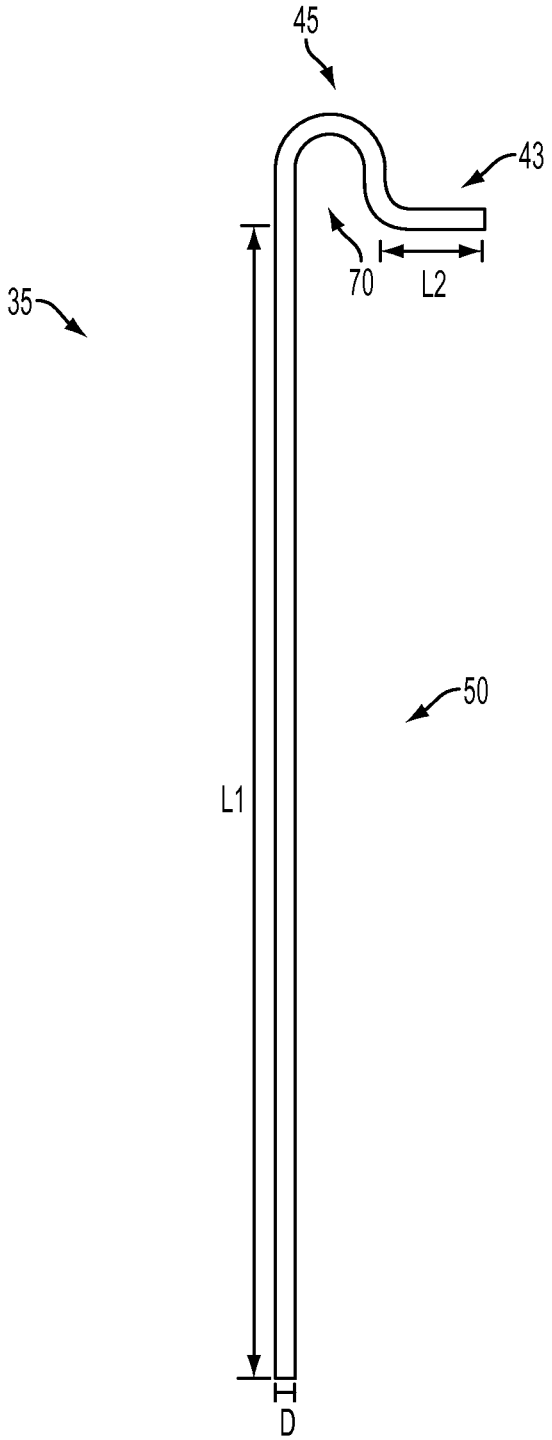
FIG. 3 depicts a drop rod that may be utilized with the gate stop, according to one or more embodiments shown and described herein.

FIG. 3 depicts the drop rod 35 that may be utilized with the gate stop 10, according to one or more embodiments shown and described herein. As illustrated, the drop rod 35 may include a handle portion 43, a curved neck portion 45, and a rod securing portion 50. The rod securing portion 50, when placed in the engaged position, may couple to the ground or to the rod engagement piece 55 (FIG. 1) to restrict the movement of the gate 5. In operation, the curved neck portion 45 may be curved to removably secure to a second rail of the gate 5 when placed in the disengaged position. While not explicitly depicted in FIG. 2, the drop rod 35 may additionally include a rod disengagement piece for securing the drop rod 35 to the first rail 15 (FIG. 1) when the gate stop 10 is placed in the disengaged position. As an example, the handle portion 43 may includes a portion that extends toward the rod securing portion 50. The rod disengagement piece may be hinged to receive and removably secure the second rail 65 in the inner neck diameter 70.

As illustrated, the curved neck portion 45 of the drop rod 35 may have an inner neck diameter 70 that is larger than an outer rail diameter of the second rail 65. In some embodiments, the inner neck diameter 70 may be very close to the outer rail diameter to frictionally secure the drop rod 35 to the second rail when placed in the disengaged position. This may restrict the rotation of the drop rod 35 and prevent unintentionally removing the gate stop 10 from the disengaged position.

Figure 4A:
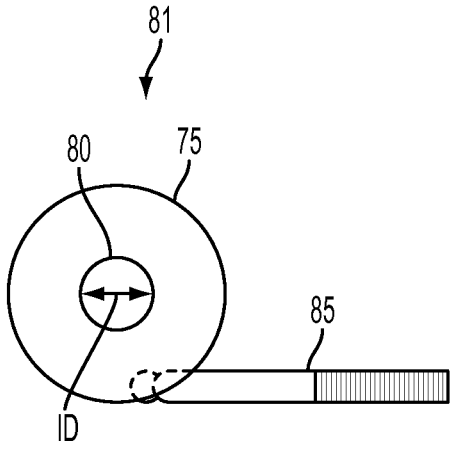
FIGS. 4A and 4B depict a mounting piece that may be utilized for securing the drop rod to the gate, according to one or more embodiments shown and described herein.
Figure 4B:
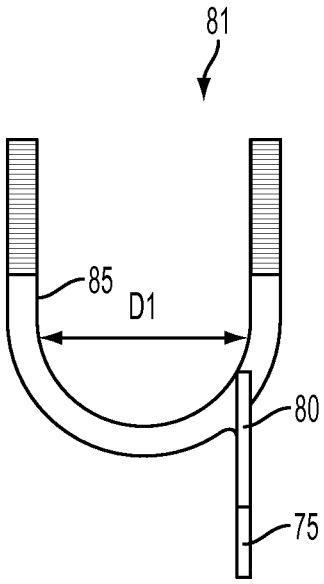
Figure 5A:
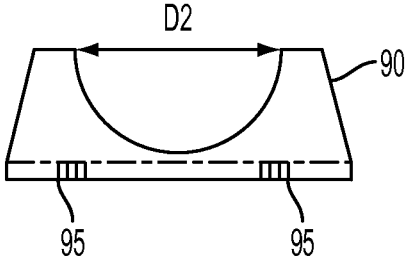
FIGS. 5A and 5B depict a securing piece that may be utilized for securing the gate top assembly to the gate, according to one or more embodiments shown and described herein.
Figure 5B:
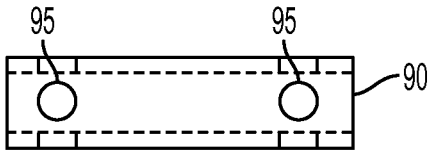

FIGS. 4A and 4B depict a mounting piece 81 that may be utilized for securing the drop rod 35 to the gate 5, according to one or more embodiments shown and described herein. As discussed above, a first guide assembly 40*a* (FIG. 1) may include a first mounting piece 81 and a first securing piece 90 (FIGS. 5A and 5B). The first mounting piece 81 may include a first ring portion 75 and a first rail securing portion 85. The first ring portion 75 may define a first rod aperture 80 and a first plane and is coupled to the first rail securing portion 85. The first rail securing portion 85 may define a second plane. A second plane may be substantially orthogonal to the first plane.

In some embodiments, the rail securing portion 85 may be u-shaped for receiving a rail 15 on the gate 5. The rail securing portion 85 may also include a threaded end for securing the guide assembly 40 to the rail 15. Some embodiments however may use a clip, a weld, an adhesive, and/or other mechanism for securing the guide assembly 40 to the rail 15.

The ring portion 75 may define a rod aperture 80 with an inner aperture diameter ID. The inner aperture diameter ID is larger than the rod diameter D (FIG. 3) of the drop rod 35. This relationship between the inner aperture diameter ID and the rod diameter D allows the drop rod to be slideably coupled with the ring portion 75 and to be rotatably secured to the ring portion 75.

Having described the components of the guide assembly 40*a*, embodiments may also include a second guide assembly 40*b* (FIG. 2). While the second guide assembly 40*b* may be completely different than the first guide assembly 40*a*, in some embodiments the second guide assembly 40*b* includes a second mounting piece and a second securing piece. The second mounting piece may include a second ring portion and a second threaded u-shaped portion. The second ring portion may define a second rod aperture and a third plane and is coupled to the second threaded u-shaped portion. The second securing piece may define a second mount aperture and a fourth plane. The fourth plane may be substantially orthogonal to the third plane. The second mount aperture receives the second threaded u-shaped portion of the second mounting piece and receives fastening devices that couple with the threads of the second threaded u-shaped portion to secure the second guide assembly 40*b* to a third rail 62 of the gate 5. The rod securing portion 50 may be inserted into the first rod aperture and the second rod aperture to sideably couple the drop rod 35 with the first guide assembly 40*a* and the second guide assembly 40*b* thereby substantially aligning the drop rod 35 vertically, relative to ground and reducing lateral movement. As such, the second guide assembly 40*b* may be configured to reduce lateral movement of the drop rod 35, relative to ground and guides the drop rod 35 to the rod engagement piece 55.

FIGS. 5A and 5B depict a securing piece 90 that is also part of the guide assembly 40. The securing piece 90 may include a mount aperture 95 that aligns with the rail securing portion 85 of mounting piece 81 (FIGS. 4A and 4B) for securing the guide assembly 40 to the rail 15. A bolt, screw, adhesive, and/or other fastener may be used to compress the securing piece 90 and the ring portion 75 together to surround the rail 15 and create a compression fit on the rail 15, thereby securing the guide assembly 40 to the gate 5.

As also illustrated, the securing piece 90 includes an inner diameter D2. Referring back to FIG. 4B, the guide assembly 40 includes an inner diameter D1. The inner diameter D1 and the inner diameter D2 may be the same or similar and may correspond to a diameter of the rail 15 from FIG. 1. This allows the guide assembly 40 to be securely fastened to the one or more rails 15 when the rail securing portion 85 is threaded through the mount aperture 95 of the securing piece 90. A bolt or other fastener may be used to compress the securing piece 90 and the ring portion 75 together to surround the one or more rails 15 and create a compression fit on the one or more rails 15 to secure the guide assembly 40 to the gate 5. The securing piece 90 and the rail securing portion 85 may also include a plurality of teeth to bite into the one or more rails 15 to prevent the guide assembly 40 from sliding and/or rotating on the one or more rails 15.

Figure 6A:
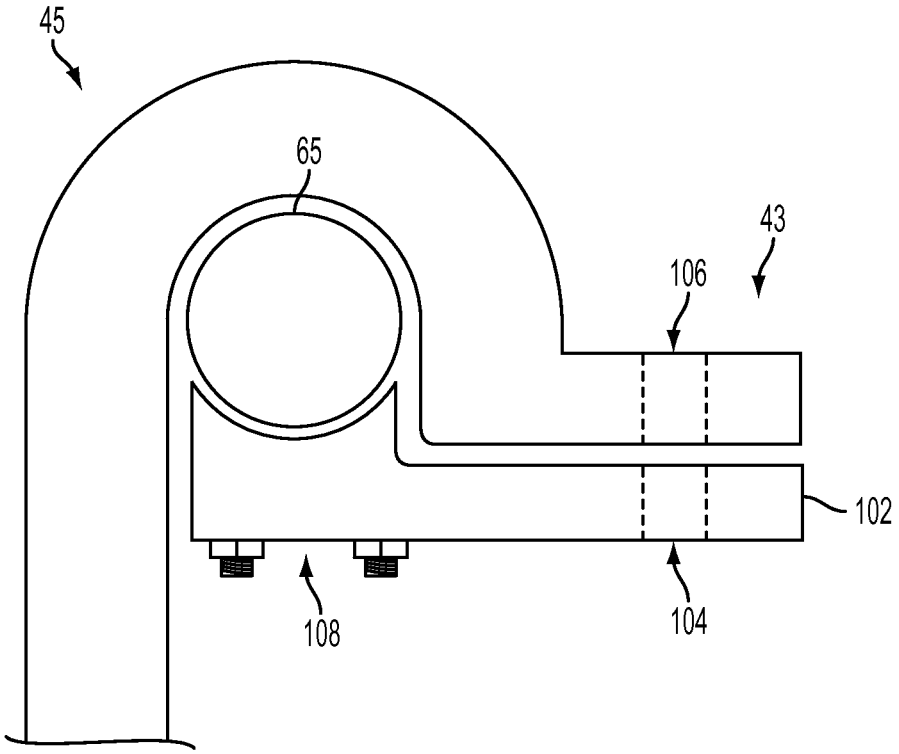
FIGS. 6A and 6B depict a disengagement securing piece, according to one or more embodiments shown and described herein.
Figure 6B:
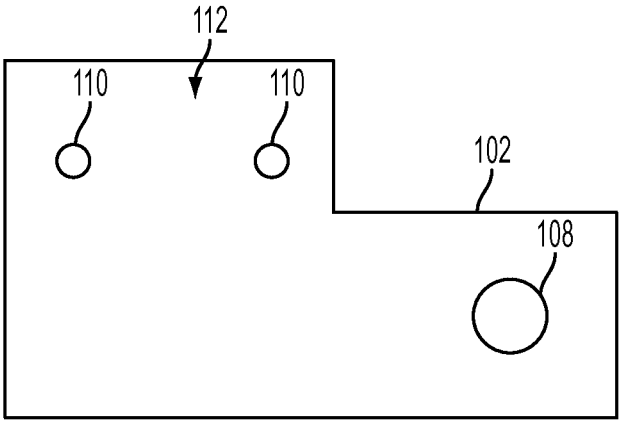

FIGS. 6A and 6B depict a disengagement securing piece 102, according to one or more embodiments shown and described herein. While in some embodiments the drop rod 35 may include a disengagement piece, FIGS. 6A, 6B depict that the disengagement securing piece 102 may be separate from the drop rod 35 and may instead be coupled to the gate 5. In such embodiments, the disengagement securing piece 102 may removably secure the drop rod 35 in the disengaged position. The handle portion 43 may define a handle aperture 106 and the disengagement securing piece 102 may define a disengaged aperture 104. When the drop rod 35 is the disengaged position, the handle aperture 106 and the disengaged aperture 104 align to allow a locking apparatus, such as a key lock, combination lock, a bolt and nut, a zip tie, or the like to secure the drop rod 35 in the disengaged position. The disengagement securing piece 102 may be coupled to the gate 5 by welding or an adhesive, screws, etc. The disengagement securing piece 102 may be coupled to the second rail 65 and be positioned either above or below the handle portion 43.

Figure 7A:
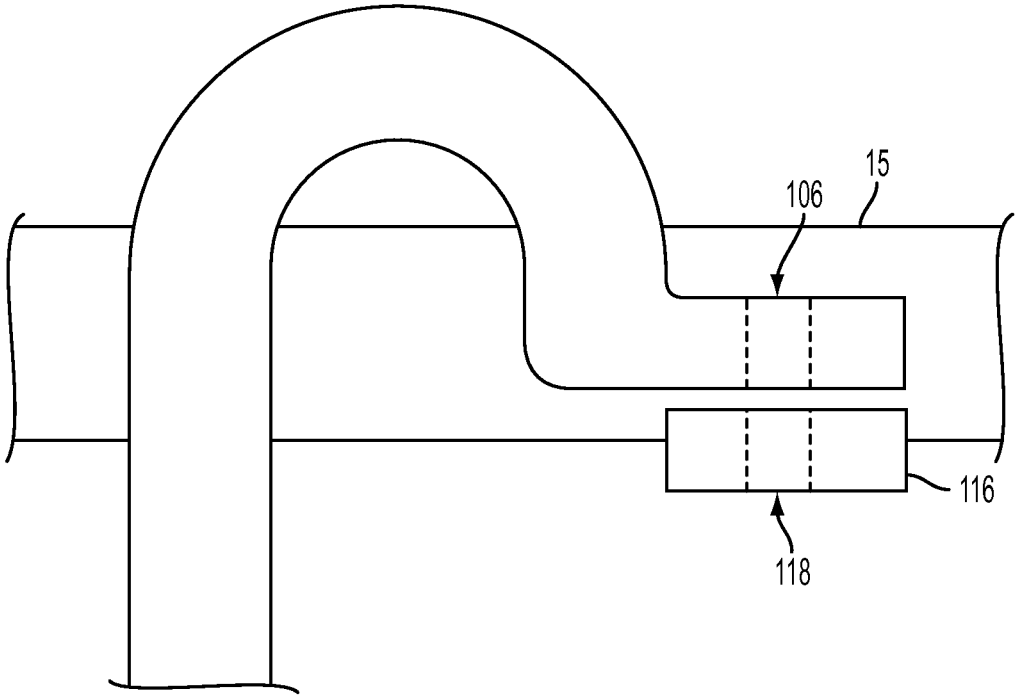
FIGS. 7A and 7B depict an engagement securing piece, according to one or more embodiments shown and described herein.
Figure 7B:
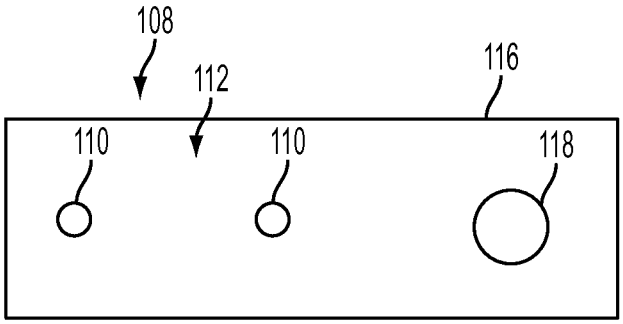

FIGS. 7A and 7B depict an engagement securing piece 116, according to one or more embodiments shown and described herein. The engagement securing piece 116 may be coupled to the gate 5 and may removably secure the drop rod 35 in the engaged position. As an example, the engagement securing piece 116 may include a ring that attaches to the rail 15. The ring may also include an extension portion, which defines an engaged aperture 118. In such an embodiment, the drop rod 35 may define a handle aperture. When the drop rod 35 is the engaged position, the drop rod 35 may be rotated to be substantially parallel with the rail, thus aligning and the engaged aperture 118 with the handle aperture 106 to allow a locking apparatus to secure the drop rod 35 in the engaged position. The engagement securing piece 116 may be secured to the gate 5 by a weld, an adhesive, and/or other similar securing mechanisms.

Certain terminology is used in the disclosure for convenience only and is not limiting. The words "left," "right," "front," "back," "top," "bottom," "upper," and "lower," "elevation," "vertical," and "horizontal" designate directions in the drawings to which reference is made. The terminology includes the words noted above as well as derivatives thereof and words of similar import.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A gate assembly, comprising:

a gate with a first rail, a second rail and a third rail, wherein the gate is coupled to an upright post, and wherein the second rail is vertically elevated above both the first rail and the third rail with respect to ground; and a gate stop that is coupled to the gate, the gate stop comprising:

a first guide assembly that includes a first mounting piece and a first securing piece, wherein the first mounting piece includes a first ring portion and a first threaded u-shaped portion, wherein the first ring portion defines a first rod aperture and a first plane, wherein the first ring portion is coupled to the first threaded u-shaped portion, wherein the first securing piece defines a first mount aperture and a second plane that is substantially orthogonal to the first plane, and wherein the first mount aperture receives the first threaded u-shaped portion of the first mounting piece and receives fastening devices that couple with a threads of the first threaded u-shaped portion to secure the first guide assembly to the first rail of the gate;

a second guide assembly that includes a second mounting piece and a second securing piece, wherein the second mounting piece includes a second ring portion and a second threaded u-shaped portion, wherein the second ring portion defines a second rod aperture and a third plane and is coupled to the second threaded u-shaped portion, wherein the second securing piece defines a second mount aperture and a fourth plane that is substantially orthogonal to the third plane, and wherein the second mount aperture receives the second threaded u-shaped portion of the second mounting piece and receives fastening devices that couple with the threads of the second threaded u-shaped portion to secure the second guide assembly to the third rail of the gate;

a drop rod that includes a handle portion, a curved neck portion, and a rod securing portion, wherein the handle portion is coupled to the curved neck portion, wherein the curved neck portion is coupled to the rod securing portion, wherein the curved neck portion has an inner neck diameter that is larger than an outer rail diameter of the second rail, wherein the rod securing portion is inserted into the first rod aperture and the second rod aperture to slideably couple the drop rod with the first guide assembly and the second guide assembly thereby substantially aligning the drop rod vertically, relative to ground and reducing lateral movement, and wherein when the drop rod is put in a disengaged position, the curved neck portion removably couples to the second rail to allow motion of the gate; and a disengagement securing piece that is coupled to the gate and removably secures the drop rod in the disengaged position, wherein the handle portion defines a handle aperture and the disengagement securing piece defines a disengaged aperture, and wherein when the drop rod is the disengaged position, the handle aperture and the disengaged aperture align to allow a locking apparatus to secure the drop rod in the disengaged position.

2. The gate assembly of claim 1, further comprising:

a rod engagement piece that is coupled to the ground and engages with the drop rod, such that when the drop rod is put in an engaged position, the rod engagement piece removably secures the drop rod to secure the gate in a relatively fixed position, and wherein the rod engagement piece includes at least one of the following: a pipe removably secured to the ground and vertically aligned with the drop rod, a curb removably secured to the ground, and a pavement surface that defines a pavement aperture for receiving the drop rod; and an engagement securing piece that is coupled to the gate and removably secures the drop rod in the engaged position, wherein the engagement securing piece defines an engaged aperture, and wherein when the drop rod is the engaged position, the handle aperture and the engaged aperture align to allow the locking apparatus to secure the drop rod in the engaged position.

3. A gate assembly, comprising:

a gate with a first rail and a second rail, wherein the gate is coupled to an upright post; and a gate stop that is coupled to the gate, the gate stop comprising:

a first guide assembly that includes a first mounting piece and a first securing piece, wherein the first mounting piece includes a first ring portion and a first rail securing portion, wherein the first ring portion defines a first rod aperture and is coupled to the first rail securing portion, wherein the first securing piece defines a first mount aperture, and wherein the first mount aperture receives the first rail securing portion of the first mounting piece to secure the first guide assembly to the first rail of the gate;

a drop rod that includes a handle portion, a curved neck portion, and a rod securing portion, wherein the handle portion is coupled to the curved neck portion, wherein the curved neck portion is coupled to the rod securing portion, wherein the rod securing portion is inserted into the first rod aperture to sideably couple the drop rod with the first guide assembly thereby substantially aligning the drop rod vertically, relative to ground, and wherein when the drop rod is put in a disengaged position, the curved neck portion removably couples to the second rail to allow motion of the gate; and a disengagement securing piece that is coupled to the gate and removably secures the drop rod in the disengaged position.

4. The gate assembly of claim 3, further comprising a rod engagement piece that is coupled to the ground and engages with the drop rod, such that when the drop rod is put in an engaged position, the rod engagement piece removably secures the drop rod to secure the gate in a relatively fixed position.

5. The gate assembly of claim 4, wherein the rod engagement piece includes at least one of the following: a pipe removably secured to the ground and vertically aligned with the drop rod, a curb removably secured to the ground, and a pavement surface that defines a pavement aperture for receiving the drop rod.

6. The gate assembly of claim 4, wherein the handle portion of the drop rod is aligned in a first direction when the drop rod is put in the disengaged position to allow the curved neck portion to removably couple to the second rail and wherein the handle portion of the drop rod is aligned in a second direction to allow the drop rod to be set in the engaged position, wherein the first direction is different than the second direction.

7. The gate assembly of claim 4, further comprising an engagement securing piece that is coupled to the gate and removably secures the drop rod in the engaged position, wherein the handle portion defines a handle aperture and the engagement securing piece defines an engaged aperture, and wherein when the drop rod is the engaged position, the handle aperture and the engaged aperture align to allow a locking apparatus to secure the drop rod in the engaged position.

8. The gate assembly of claim 3, wherein the first ring portion defines a first plane and wherein the first rail securing portion defines a second plane that is substantially orthogonal to the first plane.

9. The gate assembly of claim 3, further comprising a second guide assembly, wherein the second guide assembly slideably couples with the drop rod to reduce lateral movement of the drop rod, relative to ground.

10. The gate assembly of claim 9, wherein the second guide assembly includes a second mounting piece and a second securing piece, wherein the second mounting piece includes a second ring portion and a second rail securing portion, wherein the second ring portion defines a second rod aperture and is coupled to the second rail securing portion, wherein the second securing piece defines a second mount aperture, and wherein the second mount aperture receives the second rail securing portion of the second mounting piece to secure the second guide assembly to a third rail of the gate; and wherein the first guide assembly and the second guide assembly align the drop rod substantially vertically, relative to ground.

* * * * *